US005582660A

United States Patent [19]

Erickson et al.

[11] Patent Number: 5,582,660

[45] Date of Patent: Dec. 10, 1996

[54] HIGHLY FORMABLE ALUMINUM ALLOY ROLLED SHEET

[75] Inventors: Rolf B. Erickson, Pittsburgh; Shawn J. Murtha, Monroeville, both of Pa.

[73] Assignee: Aluminum Company of America, Pittsburgh, Pa.

[21] Appl. No.: 362,380

[22] Filed: Dec. 22, 1994

[51] Int. Cl.[6] ..... C22F 1/04

[52] U.S. Cl. ..... 148/688; 148/552; 148/693; 148/697; 148/700; 148/417; 148/439; 420/534; 420/537; 420/538; 420/546; 420/547

[58] Field of Search ..... 148/552, 688, 148/693, 697, 700, 417, 439; 420/534, 537, 538, 546, 547

[56] References Cited

U.S. PATENT DOCUMENTS

| | | | |
|---|---|---|---|
| 4,000,007 | 12/1976 | Develay et al. | 148/523 |
| 4,082,578 | 4/1978 | Evancho et al. | 148/535 |
| 4,174,232 | 11/1979 | Lenz et al. | 148/552 |
| 4,424,084 | 1/1984 | Chisholm | 148/417 |
| 4,525,326 | 6/1985 | Schwellinger et al. | 420/535 |
| 4,589,932 | 5/1986 | Park | 148/690 |
| 4,614,552 | 9/1986 | Fortin et al. | 148/417 |
| 4,718,948 | 1/1988 | Komatsubara et al. | 148/552 |
| 4,784,921 | 11/1988 | Hyland et al. | 148/417 |
| 4,808,247 | 2/1989 | Komatsubara et al. | 148/552 |
| 4,814,022 | 3/1989 | Constant et al. | 148/552 |
| 4,840,852 | 6/1989 | Hyland et al. | 148/417 |
| 4,897,124 | 1/1990 | Matsuo et al. | 148/552 |
| 5,266,130 | 11/1993 | Uchida et al. | 148/552 |

FOREIGN PATENT DOCUMENTS 0480402 4/1992 European Pat. Off. .

*Primary Examiner*—David A. Simmons
*Assistant Examiner*—Robert R. Koehler
*Attorney, Agent, or Firm*—David W. Pearce-Smith

[57] ABSTRACT

A process for fabricating an aluminum alloy rolled sheet particularly suitable for use for an automotive body, the process comprising: (a) providing a body of an alloy comprising about 0.8 to about 1.3 wt. % silicon, about 0.2 to about 0.6 wt. % magnesium, about 0.5 to about 1.8 wt. % copper, about 0.01 to about 0.1 wt. % manganese, about 0.01 to about 0.2 wt. % iron, the balance being substantially aluminum and incidental elements and impurities: (b) working the body to produce a sheet; (c) solution heat treating the sheet; and (d) rapidly quenching the sheet. In a preferred embodiment, the solution heat treat is performed at a temperature greater than 840° F. and the sheet is rapidly quenched. The resulting sheet has an improved combination of excellent formability and good strength.

30 Claims, 3 Drawing Sheets

HIGHLY FORMABLE ALUMINUM ALLOY ROLLED SHEET

TECHNICAL FIELD

The present invention relates to an aluminum alloy rolled sheet for forming and a production process therefor. More particularly, the present invention relates to an aluminum alloy rolled sheet for forming which is suitable for applications requiring the combination of excellent formability and good strength and which has been subjected to paint baking, such as in an application for an automobile body.

Because of the increasing emphasis on producing lower weight automobiles in order, among other things, to conserve energy, considerable effort has been directed toward developing aluminum alloy products suited to automotive applications. Especially desirable would be a single aluminum alloy product useful in several different automotive applications. Such would offer scrap reclamation advantages in addition to the obvious economies in simplifying metal inventories. Yet, it will be appreciated that different components on the automobile can require different properties in the form used. For example, an aluminum alloy sheet when formed into shaped outside body panels should be capable of attaining high strength which provides resistance to denting as well as being free of Lueders' lines. Lueders' lines are lines or markings appearing on the otherwise smooth surface of metal strained beyond its elastic limit, usually as a result of a non-uniform flow during forming operations, and reflective of metal movement during those operations. Conversely, the strength and the presence or absence of such lines on aluminum sheet used for inside support panels, normally not visible, is less important. Bumper applications on the other hand require such properties as high strength, resistance to denting, resistance to stress corrosion cracking and exfoliation corrosion. To serve in a wide number of automotive applications, an aluminum alloy product needs to possess excellent forming characteristics to facilitate shaping, drawing, bending and the like, without cracking, tearing, Lueders' lines or excessive wrinkling or press loads, and yet be possessed of adequate strength. Since forming is typically carried out at room temperature, formability at room or low temperatures is often a principal concern. Still another aspect which is considered important in automotive uses is weldability, especially resistance spot weldability. For example, the outside body sheet and inside support sheet of a dual sheet structure such as a hood, door or trunk lid are often joined by spot welding, and it is important that the life of the spot welding electrode is not unduly shortened by reason of the aluminum alloy sheet so as to cause unnecessary interruption of assembly line production, as for electrode replacement. Also, it is desirable that such joining does not require extra steps to remove surface oxide, for example. In addition, the alloy should have high bending capability without cracking or severe surface roughening, since often the structural products are fastened or joined to each other by hemming or seaming.

Various aluminum alloys and sheet products thereof have been considered for automotive applications, including both heat treatable and non-heat treatable alloys. Heat treatable alloys offer an advantage in that the parts formed from these alloys can be produced at a given lower strength level in the solution treated and quenched temper which can be later increased by artificial aging after the panel is shaped. This offers easier forming at a lower strength level which is thereafter increased for the end use. Further, the thermal treatment to effect artificial aging can sometimes be achieved during a paint bake treatment, so that a separate step for the strengthening treatment is not required. Non-heat treatable alloys, on the other hand, are typically strengthened by strain hardening, as by forming and/or cold rolling. These strain or work hardening effects are usually diminished during thermal exposures such as paint bake or cure cycles, which can partially soften or relax the strain hardening effects.

Accordingly, it would be advantageous to provide robust sheet materials having a combination of excellent formability and good strength.

The primary object of the present invention is to provide a method for producing an aluminum sheet product having a combination of excellent formability and good strength for automotive applications.

Another objective of the present invention is to provide a composition that it capable of being produced into an aluminum sheet product which has considerably improved characteristics, particularly in formability and strength.

These and other objects and advantages of the present invention will be more fully understood and appreciated with reference to the following description.

SUMMARY OF THE INVENTION

In accordance with the present invention there is provided a process for fabricating an aluminum alloy rolled sheet particularly suitable for use for an automotive body, the process comprising: (a) providing a body of an alloy comprising, or preferably consisting essentially of, about 0.8 to about 1.3 wt. % silicon, about 0.2 to about 0.6 wt. % magnesium, about 0.5 to about 1.8 wt. % copper, about 0.01 to about 0.1 wt. % manganese, about 0.01 to about 0.2 wt. % iron, the balance being substantially aluminum and incidental elements and impurities; (b) working the body to produce the sheet; (c) solution heat treating the sheet; and (d) rapidly quenching the sheet. The sheet has an improved formability and strength.

In a preferred embodiment, the composition includes about 1.0 to about 1.2 wt. % silicon, about 0.2 to about 0.45 wt. % magnesium, about 0.6 to about 1.5 wt. % copper, about 0.04 to about 0.08 wt. % manganese and about 0.05 to about 0.17 wt. % iron.

In a second aspect of the invention, there is provided a method for producing an aluminum alloy sheet for forming comprising the steps of: casting an alloy ingot having the composition of the above-mentioned composition by a continuous casting or semicontinuous DC (direct chill) casting; homogenizing the alloy ingot at a temperature of from 450° to 602° C. (842° to 1115° F.) for a period of from 1 to 48 subsequently rolling until a requisite sheet thickness is obtained; holding the sheet at a temperature of from 450° to 602° C. for a period of at least 5 seconds, followed by rapidly quenching; and, aging at room temperature.

BRIEF DESCRIPTION OF THE DRAWINGS

Other features of the present invention will be further described in the following related description of the preferred embodiment which is to be considered together with the accompanying drawing wherein.

DEFINITIONS

Figure 1:
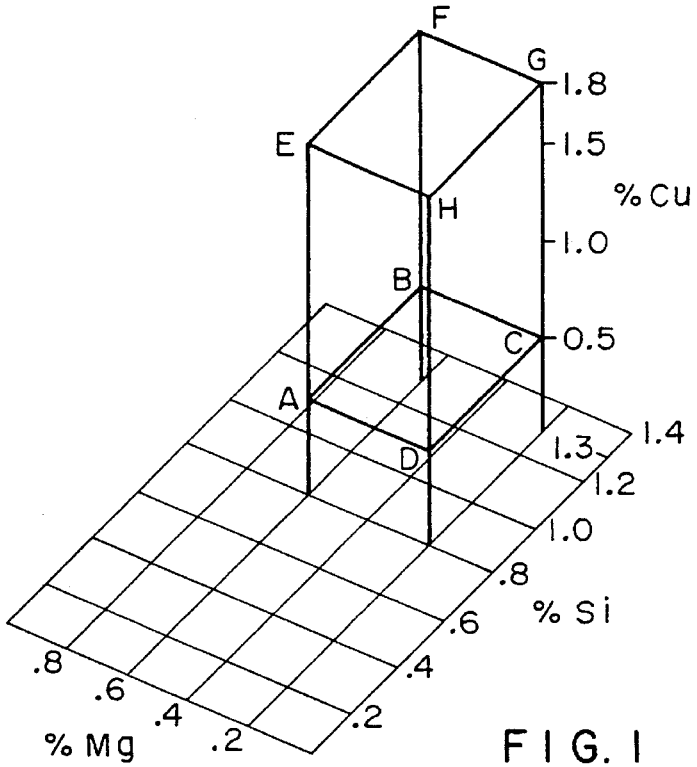
FIG. 1 is a perspective view of the compositional ranges for the Si, Mg and Cu contents of the aluminum alloy sheet according to the present invention.

The term "formability" is used herein to mean the extent to which a sheet material can be deformed in a particular deformation process before the onset of failure. Typically, failure occurs in aluminum alloys by either localized necking of the sheet or ductile fracture. Different measures of formability are known in the art and described in "Formability of Aluminum Sheet Materials" by J. M. Story, Aluminum 62 (1986) 10, pp. 738–742 and 62 (1986) 11, pp. 835–839.

The term "sheet" as used broadly herein is intended to embrace gauges sometimes referred to as "plate" and "foil" as well as gauges intermediate to plate and foil.

The term "ksi" shall mean kilopounds (thousand pounds) per square inch.

The term "minimum" with respect to a property shall mean the property level at which 99% of the product is expected to conform with 95% confidence using standard statistical methods. Properties include, strength and formability.

The term "ingot-derived" shall mean solidified from liquid metal by known or subsequently developed casting processes rather than through powder metallurgy or similar techniques. The term expressly includes, but shall not be limited to, direct chill (DC) continuous casting, slab casting, block casting, spray casting, electromagnetic continuous (EMC) casting and variations thereof.

The term "solution heat treat" is used herein to mean that the alloy is heated and maintained at a temperature sufficient to dissolve soluble constituents into solid solution where they are retained in a supersaturated state after quenching. Preferably, the solution heat treatment of the present invention is such that substantially all soluble second phase particles are dissolved into solid solution.

The term "rapidly quench" is used herein to mean to cool the material at a rate sufficient that preferably substantially all of the soluble constituents, which were dissolved into solution during solution heat treatment, are retained in a supersaturated state after quenching. The cooling rate can have a substantial effect on the properties of the quenched alloy. Too slow a quench rate, such as that associated with warm water quench or misting water, can cause precipitate particles to prematurely come out of solution. Precipitate particles coming out of solution during a slow quench have a tendency to precipitate heterogenously and have been associated with poor bending performance. Quench rates are considered to be rapid if they do not result in the appreciable precipitation of particles from solution. Rapid quench rates can be achieved by various methods, including cold water quenching, forced air quenching and water spray or water mist quenching.

Hence, in accordance with the invention, the terms "formed panel" and "vehicular formed panel" as referred to herein in their broadest sense are intended to include bumpers, doors, hoods, trunk lids, fenders, fender wells, floors, wheels and other portions of an automotive or vehicular body. For example, such a panel can be fashioned from a flat sheet which is stamped between mating dies to provide a three-dimensional contoured shape, often of a generally convex configuration with respect to panels visible from the outside of a vehicle. Other techniques useful for fabricating panels include roll forming, hydroforming and various forming techniques known to the art. Dual or plural panel members comprise two or more formed panels, typically an inside and an outside panel, the individual features of which are as described above. The inner and outer panels can be peripherally joined or connected to provide the dual or plural panel assembly, as shown in U.S. Pat. No. 4,082,578, the teachings of which are incorporated herein by reference.

The terms "automotive" or "vehicular" as used herein are intended to refer to automobiles, of course, but also to trucks, off-road vehicles and other transport vehicles such as planes, trains and boats.

Mode for Carrying Out the Invention

Turning first to FIG. 1, there is illustrated a perspective view of the range Si, Mg and Cu contents of the aluminum alloy sheet according to the present invention. The cubic area defined by points A–H illustrate the claimed area for the Si, Mg and Cu contents of the claimed alloys. Points A–D are all located on the 0.5 wt. % copper plane. Points E-H are all located on the 1.8 wt. % copper plane. The weight percent of Mg and Si for points A and E, B and F, C and G, and D and H are the same.

In addition to Si, Mg and Cu, the alloys of the present invention also include Mn and Fe as essential components of the alloy. Each of the essential elements have a role that is performed synergistically as described below.

The Si strengthens the alloy due to precipitation hardening of elemental Si and $Mg_2Si$ formed under the co-presence of Mg. In addition to the effective strengthening, Si also effectively enhances the formability, particularly the stretching formability. When the Si content is less than about 0.8 wt. %, the strength and formability are unsatisfactory. On the other hand, when the Si content exceeds about 1.3 wt. %, the soluble particles cannot always be put into solid solution during heat treatment without melting the alloy. Hence, the formability and mechanical properties of the resulting sheet would be degraded. The Si content is preferably maintained in or about the range of 0.8 wt. % to 1.3 wt. %.

As is described above, Mg is an alloy-strengthening element that works by forming $Mg_2Si$ under the co-presence of Si. This result is not effectively attained at an Mg content of less than about 0.2 wt. %. Although Mg is effective in enhancing the strength of aluminum alloys, at higher levels and in amounts exceeding that needed for forming $Mg_2Si$, Mg reduces the formability of the alloy. The Mg content is preferably maintained in or about the range of 0.2 to 0.6 wt. %.

Cu is an element that enhances the strength and formability of aluminum alloys. It is difficult to attain sufficient Strength while maintaining or improving the formability only by the use of Mg and Si. Cu is therefore indispensable. It is desirable to have Cu in the alloy for purposes of strength and formability. When the copper levels are less than about 0.5 wt. %, the resulting product exhibits low strength and low formability (see FIGS. 2 and 3). When the copper levels are greater than 1.8%, the resulting product exhibits a decrease in bending performance (see FIG. 4). The Cu content is preferably maintained in or about the range of 0.5 to 1.8 wt. %.

Fe forms particles which help refine the recrystallized grains and reduce or eliminate the alloy's susceptibility to a surface roughening phenomena known as orange peel. Therefore, Fe is desirable for grain structure control. However, too much Fe decreases the alloy's resistance to necking and/or fracture. The recrystallized grains coarsen at an Fe content of less than about 0.05 wt. %, and the formability is reduced at an Fe content exceeding 0.2 wt. %. The Fe content is preferably maintained in or about the range of 0.05 wt. % to 0.2 wt. %. Preferably, the Fe content is below about 0.17 wt. %.

Mn also helps to refine the recrystallized grains. Eliminating Mn from the alloy has been found to cause grain coarsening during heat treatment and subsequent orange peel during deformation. Hence, it is believed that Mn forms dispersoids in the alloy which stabilizes its structure. Low levels of dispersoids can effectively control the grain structure. However, it has been found that when the Mn exceeds 0.1 wt. %, the formability in plane strain stress states is reduced. Consequently, although low levels of Mn are beneficial in preventing roughening during deformation, the amount of Mn in the alloy must be limited to prevent degradations to its plane strain formability. Plane strain formability has been found to be an important characteristic in the fabrication of large formed panels such as those used in automotive applications. For example, it is thought that 80–85% of stamping failures occur in plane strain. It has been found that Mn is deskable up to levels of about 0.1 wt. %. The preferred Mn content is preferably maintained in or about the range of 0.04 to 0.08 wt. %.

The process for producing an aluminum alloy sheet according to the present invention is now explained.

The aluminum alloy ingot having a composition in the above-identified ranges is formed by an ordinary continuous casting or a semicontinuous DC casting method. The aluminum alloy ingot is subjected to homogenization to completely dissolve soluble constituent particles and to develop and refine secondary phase particles to assist in grain structure control during subsequent processing. The effects of homogenizing are not properly attained when the heating temperature is less than 450° C. (842° F.). However, when the homogenizing temperature exceeds 602° C. (1115° F.), melting may occur. Homogenization temperatures must be maintained for a sufficient period of time to insure that the ingot has been homogenized.

After the ingot has been homogenized, it is brought to the proper rolling temperature and then rolled by an ordinary method to a final gauge. Alternatively, the ingot may be brought to room temperature following homogenization and then reheated to a proper rolling temperature prior to hot rolling. The rolling may be exclusively hot rolling or may be a combined hot rolling and subsequent cold rolling. Cold rolling is desired to provide the surface finish desired for autobody panels.

The rolled sheet is subjected to the solution heat treatment at a temperature of from 450° to 602° C. (842° to 1115° F.), followed by rapid cooling (quenching). When the solution heat treatment temperature is less than 450° C. (842° F.), the solution effect can be unsatisfactory, and satisfactory formability and strength are not obtained. On the other hand, when the solution treatment is more than 602° C.(1115° F.), melting may occur. A holding of at least 5 seconds is necessary for completing solutionizing. A holding of 30 seconds or longer is preferred. The rapid cooling after the holding at a solution temperature may be such that the cooling speed is at least equal to the forced air cooling, specifically 300° C./min. or higher. As far as the cooling speed is concerned, water quenching is most preferable, forced air cooling, however, can give quenching with less distortion. The solution heat treatment is preferably carried out in a continuous solution heat treatment furnace and under the following conditions: heating at a rate of 2° C./sec or more; holding for 5 to 180 seconds or longer, and cooling at a rate of 300° C./min. or more. The heating at a rate of 2° C./sec or more is advantageous for refining the grains that recrystallize during solution heat treatment.

A continuous solution heat treatment furnace is most appropriate for subjecting the sheet, which is mass produced in the form of a coil, to the solution heat treatment and rapid cooling. The holding time of 180 seconds or less is desirable for attaining a high productivity. The slower cooling rate is more advisable for providing a better flatness and smaller sheet distortion.

The higher cooling speed (>300° C./min.) is more advisable for providing better formability and a higher strength. To attain a good flatness and no distortion, a forced air cooling at a cooling speed of 5° C./sec to 300° C./sec is preferable.

Also, between the hot rolling and solution heat treatment, an intermediate annealing treatment followed by cold rolling may be carded out to help control final grain size, crystallographic texture and/or facilitate cold rolling. The holding temperature is preferably from 316° to 554° C., more preferably from 343° to 454° C., and the holding time is preferably from 0.5 to 10 hours for the intermediate annealing. The intermediate annealed sheet of aluminum alloy is preferably cold rolled at a reduction rate of at least 30%, and is then solution heat treated and rapidly quenched.

When the temperature of the intermediate annealing is less than 316° C., the recrystallization may not be complete. When the temperature of the intermediate annealing is greater than 554° C., grain growth and discoloration of the sheet surface may occur. When the intermediate annealing time is less than 0.5 hour, a homogeneous annealing of coils in large amounts becomes difficult in a box-type annealing furnace. On the other hand, an intermediate annealing of longer than 10 hours tends to make the process not economically viable. When the solution heat treatment is carried out in a continuous solution heat treatment furnace, the intermediate annealing temperature is preferably from 343° to 454° C. A cold-rolling at a reduction of at least 30% preferably should be interposed between the intermediate annealing and solution heat treatment to prevent or reduce grain growth during the solution heat treatment.

After forming, the painting and baking or artificial aging treatment may be carded out. The baking temperature is ordinarily from approximately 150° to 250° C.

The aluminum alloy rolled sheet according to the present invention is most appropriate for application as inner hang-on panels on an automobile body and can also exhibit excellent characteristics when used for other automobile parts, such as a heat shield, an instrument panel and other so-called "body-in-white" parts.

The benefit of the present invention is illustrated in the following examples.

EXAMPLES 1–5

To demonstrate the practice of the present invention and the advantages thereof, aluminum alloy products were made having the compositions shown in Table 1, the remainder aluminum and elements and impurities. Four of the alloys fall within the composition box shown in FIG. 1. The alloys were cast to obtain ingot and fabricated by conventional methods to sheet gauges. The ingots were homogenized between 1000° and 1050° F. for at least 4 hours and hot rolled directly thereafter to a thickness of 0.125 inch, allowed to cool to room temperature, intermediate annealed and then cold rolled to a final gauge of 0.036 inch 0.036' or (1 mm). The sheet was examined prior to solution heat treatment, and significant amounts of soluble second phase particles were found to be present. Coils were solution heat treated in the range of 1000 to 1050° F. and rapidly quenched. The sheets were then naturally aged at room temperature for a period of at least two weeks. The alloys were examined, and it was found that substantially all of the second phase particles remained in the solid solution in a supersaturated state.

TABLE 1

| Alloy Example | Si | Mg | Cu | Fe | Mn | Si/Mg |
|---|---|---|---|---|---|---|
| 1 | 1.05 | 0.28 | 0.92 | 0.13 | 0.06 | 3.75 |
| 2 | 0.98 | 0.27 | 1.54 | 0.16 | 0.06 | 3.63 |
| 3 | 1.2 | 0.23 | 0.37 | 0.15 | 0.05 | 5.22 |
| 4 | 1.18 | 0.26 | 0.83 | 0.14 | 0.06 | 4.54 |
| 5 | 1.11 | 0.27 | 1.56 | 0.13 | 0.06 | 4.11 |
| 6 (AA2008) | 0.62 | 0.38 | 0.94 | 0.14 | 0.06 | 1.63 |

EXAMPLE 6

For comparison purposes, an AA2008 alloy sheet having the composition of Alloy Example 6 is shown in Table 1. The AA2008 sheet is heat treatable aluminum which is used commercially for automotive applications. AA2008 is the current benchmark for the combination of excellent formability and good strength. Typically, AA2008 is used for inner panels on automobiles.

EXAMPLES 7–12

Ingot-derived sheets of Examples 1–6 were aged naturally at room temperature (T4 temper). After at least two weeks of natural aging, the materials were tested to determine the mechanical properties. The mechanical tests were performed in three orientations: 0°, 45° and 90° to the rolling direction. The results are shown in Table 2. For purposes of comparison, some of the data is repeated in Table 3.

TABLE 2

| Example | Alloy | Sheet Orientation | Tensile Yield Strength (ksi) | Ultimate Tensile Strength (ksi) | Tensile Elong. (%) | Uniform Elong. (%) | n |
|---|---|---|---|---|---|---|---|
| 7 | 1 | 0° | 20.4 | 41.2 | 29.0 | 26.0 | 0.28 |
| | | 45° | 19.0 | 39.8 | 31.5 | 28.0 | 0.29 |
| | | 90° | 19.0 | 38.8 | 29.5 | 28.0 | 0.29 |
| | | Average | 19.47 | 39.9 | 30.0 | | |
| 8 | 2 | 0° | 23.0 | 44.8 | 28.0 | 26.0 | 0.27 |
| | | 45° | 22.0 | 43.6 | 29.5 | 28.0 | 0.27 |
| | | 90° | 21.6 | 42.4 | 29.8 | 28.0 | 0.28 |
| | | Average | 22.2 | 43.7 | 29.1 | | |
| 9 | 3 | 0° | 16.6 | 35.0 | 28.5 | 25.0 | 0.29 |
| | | 45° | 15.8 | 34.1 | 32.2 | 28.0 | 0.26 |
| | | 90° | 15.25 | 33.4 | 29.5 | 27.0 | 0.30 |
| | | Average | 15.90 | 34.2 | 30.1 | | |
| 10 | 4 | 0° | 17.4 | 34.4 | 28.8 | 26.0 | 0.28 |
| | | 45° | 19.2 | 39.6 | 32.2 | 27.0 | 0.28 |
| | | 90° | 19.2 | 39.6 | 31.8 | 27.0 | 0.29 |
| | | Average | 18.6 | 37.9 | 30.9 | | |
| 11 | 5 | 0° | 24.0 | 44.5 | 27.5 | 26.0 | 0.26 |
| | | 45° | 22.3 | 42.8 | 29.5 | 27.0 | 0.27 |
| | | 90° | 21.6 | 42.5 | 29.2 | 27.0 | 0.27 |
| | | Average | 22.6 | 43.3 | 28.7 | | |
| 12 | 6 (AA2008) | 0° | 20.9 | 38.6 | 26.45 | 22.9 | 0.26 |
| | | 90° | 18.0 | 36.0 | 30.7 | 25.3 | 0.26 |
| | | Average | 19.45 | 37.3 | 28.575 | | |

A minimum value of 15 ksi is desirable for yield strength. It is believed that the material needs to have at least this minimum value to resist damage of the naturally aged material (T4 temper) during handling and assembly. All of the experimental alloys of the present invention (Examples 1, 2, 4 and 5) exhibited yield strengths above the minimum. The alloys of Examples 2 and 5 exhibited yield strengths greater than 20 ksi. However, as will be seen below, even though these materials exhibit high strengths, the materials of Examples 2 and 5 also, are highly formable.

Figure 2:
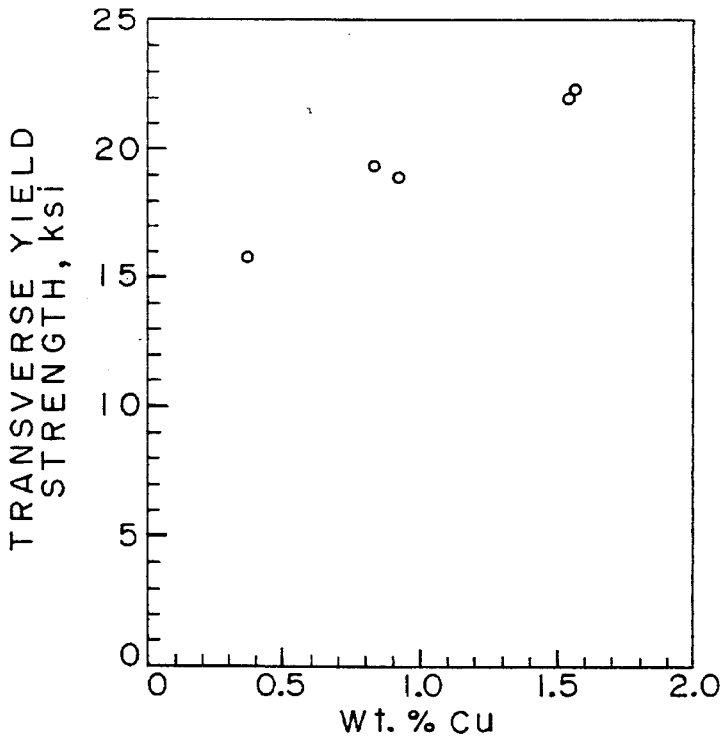
FIG. 2 is a graph illustrating the effect of copper content of the alloy of the present invention on tensile yield strength.
Figure 3:
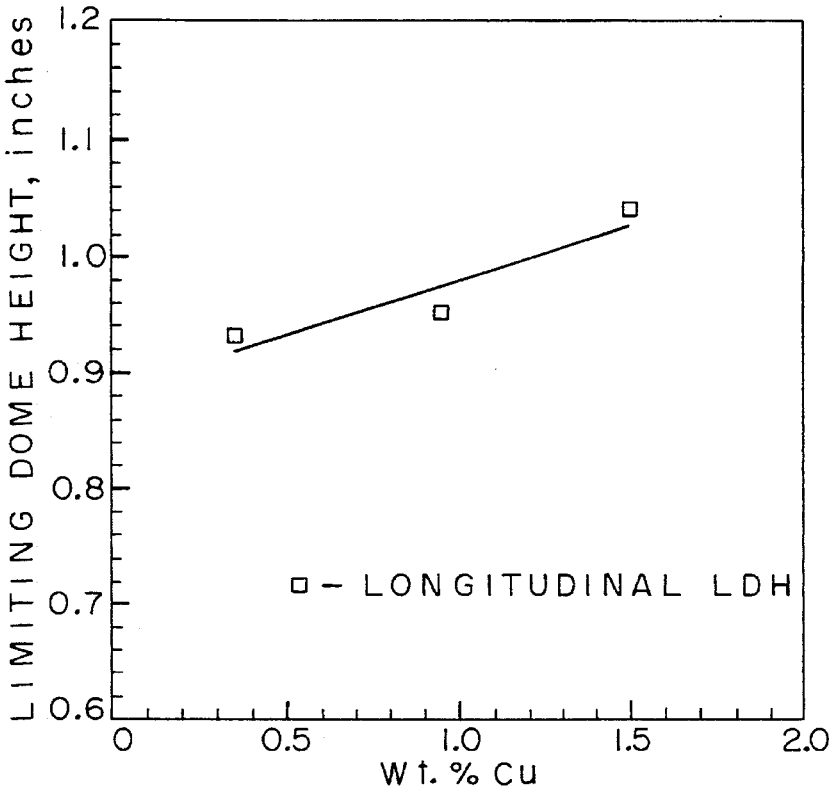
FIG. 3 is a graph illustrating the effect of copper content of the alloy of the present invention on plane strain stretching.

FIG. 2 is a graph illustrating the relationship of copper content of the alloy of the present invention to its transverse yield strengths. As the copper content increases, the transverse yield strength also increases (see FIG. 2). Sheet formed from alloys with the lower copper contents did not have adequate yield strengths, i.e., greater or equal to the commercially available AA2008. To meet or exceed the AA2008 benchmark, the alloy must have a minimum copper level greater than 0.5 wt. % (see Table 2).

The tensile elongation of the alloys of Examples 1–6 were also measured. Tensile elongation is considered to be an indirect measurement of formability. For comparison, AA2008, which is one of the most formable heat treatable alloys in use today, exhibits T4 tensile total elongation values between 25% to 30%. All of the alloys of the present invention exhibited a T4 tensile total elongation greater than or equal to about 28%. Therefore, all of these alloys appear to have better tensile elongations than AA2008. As discussed below, the materials of Examples 1, 2, 4 and 5 meet or exceed all criterion for formability.

The uniform elongation of the alloys of Examples 1–6 were also measured. Uniform elongation is a measure of a material's ability to deform uniformly prior to local deformation. It is a measurement of the maximum strain that a material can withstand prior to necking. Therefore, it is an indication of a material's resistance to necking. It is deskable to have uniform elongations greater than commercially available AA2008 (Table 2). All of the materials of the present invention exhibited a uniform elongation of 26.0% or greater. AA2008 in its T4 condition typically exhibits uniform elongations values in the range of about 22% to about 25%. Therefore, the alloys of the present invention will perform better than the current benchmark, AA2008. The variation in uniform elongation, with respect to rolling direction, was insignificant.

The strain hardening exponent of the alloys of Examples 1–6 was calculated. The strain hardening exponent is derived by measuring the slope of the true stress/strain curve within a specified strain range. Like uniform elongation, strain hardening exponent is a measure of a material's ability to deform uniformly prior to local deformation. It is desirable to have strain hardening exponent values greater than the commercial benchmark, AA2008. All of the materials of the present invention exhibited a strain hardening exponent 0.25 or greater. AA2008 in its -T4 temper typically exhibits strain hardening exponent values in the range of 0.23–0.26. Therefore, it is expected that the alloys of the present invention will perform better than the current benchmark, AA2008.

EXAMPLES 13–30

The alloys of Examples 1–6 were artificially aged by three practices to investigate the change in mechanical properties of the sheet material. The first artificial aging practice was performed by heating the material for 30 minutes at 350° F. This artificial aging practice was intended to simulate a paint bake response that the material would exhibit in commercial automotive production.

The second artificial aging practice was similar to the first practice in that the sheet material was heated for 30 minutes at 350° F. However the material was subjected to a 2% stretch prior to heating. This artificial aging practice simulates the development of properties obtainable in a typical commercial application; namely, the strain induced into the material during part forming operations followed by painting and then paint baking. Other artifical aging practices typically include at least 1% stretch prior to heating.

In the third artificial aging practice, the material was heated for 60 minutes at 400° F. This artificial aging practice was intended to determine the anticipated peak strength obtainable in a paint bake cycle in commercial production.

The results of the three artificial aging practices are shown in Table 3. For purposes of comparison, the corresponding properties of the naturally aged material (T4 temper) are repeated in Table 3.

TABLE 3

| Example | Alloy Example | Temper | Transverse Yield Strength (ksi) | Transverse Tensile Strength (ksi) | Transverse Total Elongation (%) |
|---|---|---|---|---|---|
| 7 | 1 | T4 | 18.9 | 38.8 | 29.5 |
| 13 | | 30 min. @ 350° F. | 17.1 | 35.4 | 29.8 |
| 14 | | 2% + 30 min. @ 350° F. | 22.6 | 36.7 | 26.8 |
| 15 | | 60 min. @ 400° F. | 33.1 | 42.6 | 15.8 |
| 8 | 2 | T4 | 21.6 | 42.4 | 29.8 |
| 16 | | 30 min. @ 350° F. | 18.2 | 38.6 | 30.2 |
| 17 | | 2% + 30 min. @ 350° F. | 23.7 | 39.3 | 25.8 |
| 18 | | 60 min. @ 400° F. | 33.5 | 44.6 | 16.2 |
| 9 | 3 | T4 | 15.2 | 33.3 | 29.5 |
| 19 | | 30 min. @ 350° F. | 14.6 | 30.8 | 28.2 |
| 20 | | 2% + 30 min. @ 350° F. | 21.2 | 33.1 | 23.5 |
| 21 | | 60 min. @ 400° F. | 29.4 | 37.2 | 14.2 |
| 10 | 4 | T4 | 19.2 | 39.5 | 31.8 |
| 22 | | 30 min. @ 350° F. | 17.7 | 36.6 | 29.2 |
| 23 | | 2% + 30 min. @ 350° F. | 24.0 | 38.0 | 25.5 |
| 24 | | 60 min. @ 400° F. | 33.4 | 42.8 | 15.5 |
| 11 | 5 | T4 | 21.6 | 42.2 | 29.2 |
| 25 | | 30 min. @ 350° F. | 20.3 | 39.8 | 30.2 |
| 26 | | 2% + 30 min. @ 350° F. | 26.0 | 40.7 | 25.2 |
| 27 | | 60 min. @ 400° F. | 36.8 | 47.2 | 14.8 |
| 12 | 6 | T4 | 18.0 | 36.0 | 28.0 |
| 28 | (AA2008) | 30 min. @ 350° F. | 17.4 | 33.4 | 22.8 |
| 29 | | 2% + 30 min. @ 350° F. | 22.2 | 36.1 | 24.8 |
| 30 | | 60 min. @ 400° F. | 35.0 | 43.0 | 11.0 |

Comparing the results of a 30-minute artificial age at 350° F. and the 2% stretch plus 30 minutes artificial age at 350° F., the alloy of Examples 1, 2, 4 and 5 all had strengths equal to or greater than the commercially available AA2008 (Alloy Example 6). The results of 60 minute artificial age at 400° F. show that the alloy Example 5 had strengths greater than commercially available AA2008 (see Examples 27 and 30 on Table 3).

Figure 5:
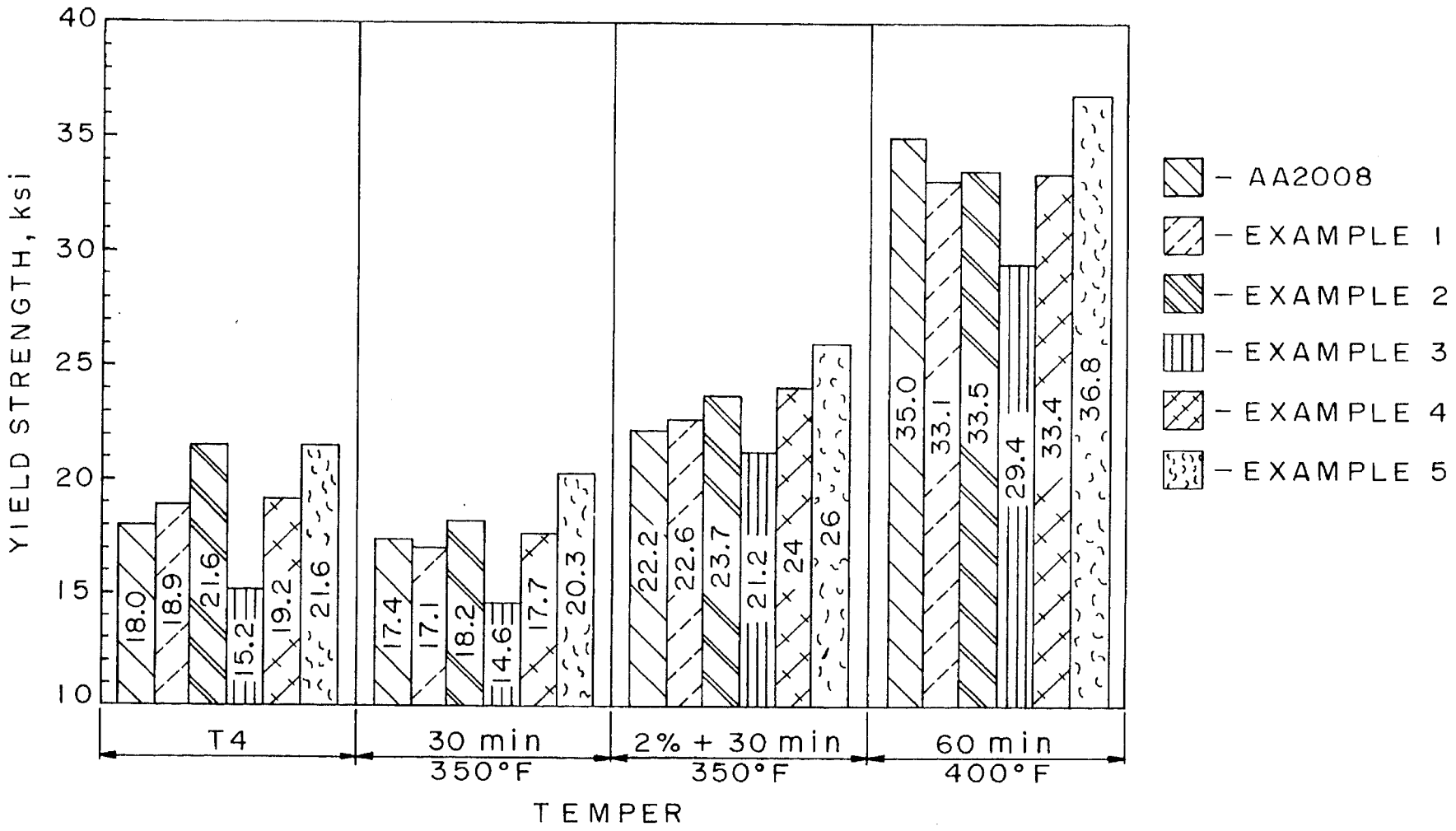
FIG. 5 is a graph illustrating the effect of simulated forming and paint baking on yield strength.

FIG. 5 illustrates the relationship of the yield strengths from Table 3 as a function of aging practice. From FIG. 5, it can be seen that the materials of Alloys Examples 1, 2, 4 and 5 have yield strengths greater than that of commercially available AA2008 (Alloy Example 6) in the temper which Simulates a forming operation, followed by painting and baking operations. The materials of Alloy Examples 1, 2, 4 and 5, which have high Cu and Si content, developed the best strength levels.

EXAMPLES 31–36

In order to investigate the formability of the alloys of Examples 1–6, sheet material was subjected to the Limited Dome Height (LDH) test.

The Limiting Dome Height (LDH) test is a method used to measure a material's plane strain stretching ability (strain hardening characteristics and limiting strain capabilities). In the standard LDH test, rectangular blanks of various widths are cut so that longest sides of the rectangular blanks correspond to the longitudinal rolling direction. The rectangular blanks are rigidly clamped and then stretched by a four-inch hemispherical punch. $LDH_o$ is the minimum punch height observed over the range of specimen widths evaluated. This is assumed to be at or near plane strain. In addition to the standard LDH test, additional samples were tested in which the longest side of the rectangular blanks corresponded to the transverse rolling direction. The transverse samples were tested using one width; namely, the same specimen width which $LDH_o$ was measured in the longitudinal direction. The results of the LDH tests are set forth in Table 4.

TABLE 4

| | | Limiting Dome Height | |
|---|---|---|---|
| Example | Alloy Example | Longitudinal Direction $LDH_o$ | Transverse Direction $LDH_o$ |
| 31 | 1 | 1.019 | 1.091 |
| 32 | 2 | 1.013 | 1.104 |
| 33 | 3 | 1.002 | 1.082 |
| 34 | 4 | 1.019 | 1.102 |
| 35 | 5 | 1.01 | 1.094 |
| 36 | 6 (AA2008) | 0.950 | 0.870 |

For the longitudinal LDH test a value of 1.00 is desired in both the longitudinal and transverse directions. This value is a target value which exceeds the performance typically observed for AA2008. All of the alloys of the present invention (Alloys 1, 2, 4 and) met or exceeded this minimum value in both directions. In addition, all of the alloys of the present invention performed significantly better than the commercially available AA2008-T4 (Alloy 6) which exhibited longitudinal $LDH_o$ of only 0.950 and a transverse $LDH_o$ of only 0.870. The commercially available alloy did not meet the minimum target value in either the longitudinal or transverse directions. Surprisingly, the alloys of the present invention (Alloys 1, 2, 4 and 5) exhibited an improvement in longitudinal LDH of 0.052"–0.069" over AA2008 and an improvement of 0.212"–0.234" over AA2008 in transverse LDH. An increase of 0.04" or greater in $LDH_o$ is thought to result in a noticeable increase in performance of the material in the shaping press. Therefore, it is believed that all alloys of the present invention of Examples 31, 32, 34 and 35 would perform significantly better than AA2008-T4 in a stamping press.

EXAMPLES 37–42

In order to further investigate the formability of the alloys of Examples 1–5, sheet material was subjected to the Guided Bend Test (GBT) and hemming test.

The 90° GBT is essentially a frictionless downflange test to predict a material's bending performance. In addition, the GBT can be used to predict if an alloy can be flat hemmed. In the 90° GBT, a pre-stretched (10%) strip is rigidly clamped and then forced to bend 90° over a die radius by a roller. The test is repeated with progressively smaller die radii until fracture occurs. The smallest die radius (R) resulting in a bend without fracture is divided by the original sheet thickness (t) to determine the minimum R/t ratio.

Materials which exhibit minimum R/t values less than about 0.5 are generally considered to be flat hem capable. Those exhibiting minimum R/t values in the range of about 0.5 to about 1.0 are considered to be marginal, and materials with minimum R/t values greater than about 1.0 are not "flat-hem capable".

Figure 4:
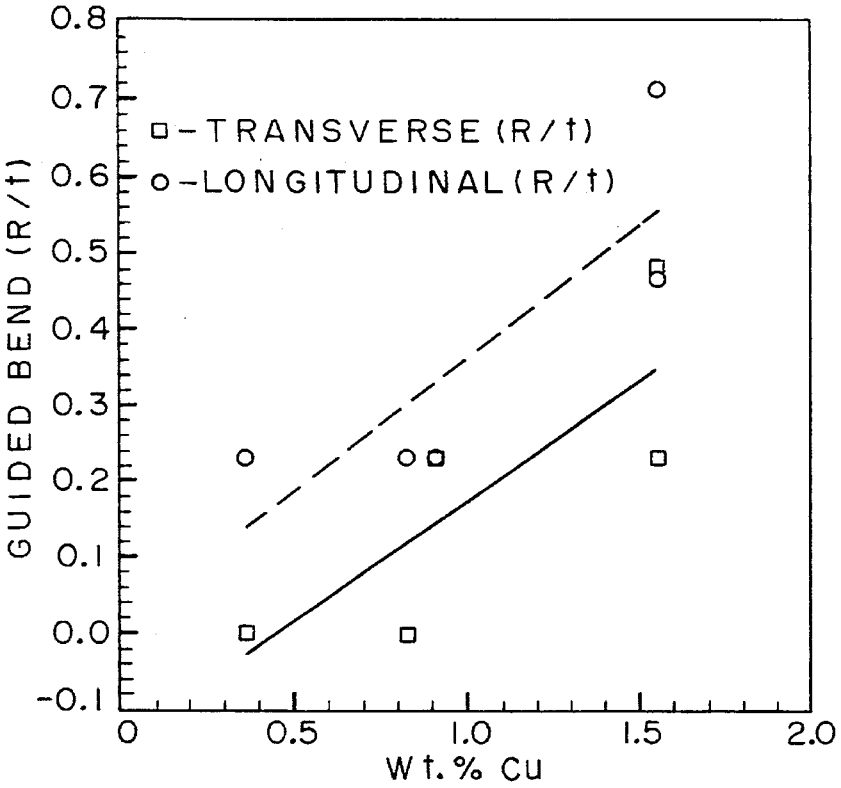
FIG. 4 is a graph illustrating the effect of copper content of the alloy of the present invention on the material's bending ability.

Another indicator of production hemming capability is the hemming test. In the hemming test, strips of sheet material are pre-stretched 7% and then hemmed to determine if it is flat hem capable. The hemmed material is assigned a rating based on visual appearance of the outer surface of the bending radius. The results of the GBT tests and hemming for the alloys of Examples 1–5 are set forth in Table 5. For comparison purposes, the GBT tests and hemming results for AA2008 (Example 6) are also included. In FIG. 4, the results of the GBT tests presented as a function of the Cu content of the Alloy Examples 1–5.

TABLE 5

| | | Guided Bend | | | |
|---|---|---|---|---|---|
| Example | Alloy | Longitudinal | Transverse | Hemming | Hemming Visual |
| 37 | 1 | 0.232 | 0.232 | flat | slight surface roughening |
| 38 | 2 | 0.462 | 0.232 | flat | slight surface roughening |
| 39 | 3 | 0.232 | 0 | flat | slight surface roughening |
| 40 | 4 | 0.232 | 0 | flat | slight surface roughening |
| 41 | 5 | 0.715 | 0.476 | flat | slight surface roughening |
| 42 | 6 | 0–0.6 | 0–0.6 | flat | slight surface roughening |

Surprisingly, the guided bend values shown for the Examples 37, 38, 40 and 41 (Alloy Examples 1–5) indicate that these materials would be "flat-hem capable" like AA2008. Hemming is a stringent requirement of manufacturers of automobile aluminum panels. AA2008 is considered to be one of the best forming heat-treatable alloys commercially available for automotive applications. Consequently, alloys which exhibit a better combination of excellent formability and good strength, such as those of Examples 1, 2, 4 and 5, can be used in the fabrication of formed panels having more demanding shapes and still provide adequate resistance to handling damage.

EXAMPLES 43–46

To demonstrate the benefit of iron and manganese in the practice of the invention and the advantages thereof, aluminum alloy products were fabricated according to a method similar to that described before. The compositions of the material of Examples 43–46 are shown in Table 6. The compositions of Examples 43 and 44 were designed to show the benefit of controlling both the iron and manganese levels. Examples 45 and 46 demonstrate the effect of increasing the iron levels within the preferred range.

TABLE 6

| Example No. | Si | Mg | Cu | Fe | Mn |
|---|---|---|---|---|---|
| 43 | 0.79 | 0.58 | 0.32 | 0.16 | 0.04 |
| 44 | 0.73 | 0.47 | 0.35 | 0.35 | 0.34 |
| 45 | 0.83 | 0.22 | 0.95 | 0.18 | 0.04 |
| 46 | 0.85 | 0.26 | 0.95 | 0.09 | 0.05 |

The sheet products were tested to determine the mechanical properties and formability as measured by LDH, Guided Bend, Stretch Bend and Bulge tests. The LDH and Guided Bend tests were conducted as described previously.

The Stretch Bend test is a recognized forming test which is used to measure formability in the bending-under-tension mode. The test is conducted by rigidly clamping a rectangular blank at its ends and then deforming the blank by a punch until fracture occurs. The value reported (H/t) is the distance the punch has traveled at peak load divided by the sheet thickness.

The Bulge test is a recognized forming test used to measure a material's ability to deform after large strains in bi-axial stress states. The test is conducted by deforming a rigidly clamped square blank with pressurized hydraulic fluid. The pressurized fluid generates a frictionless force which deforms the material. One parameter used to measure a material's performance during the Bulge test is the maximum distance the material has deformed (Bulge Height) prior to failure.

As can be seen in Table 7, the alloy containing higher Fe (Example 45 exhibited inferior formability values compared to similar alloys with lower amounts of Fe (Example 46). The superior formability values of Example 46 are indicated by higher average N values, longitudinal uniform elongation values, transverse stretch bend and bulge height measurements.

TABLE 7

| | Example No. | | | |
|---|---|---|---|---|
| Test | 43 | 44 | 45 | 46 |
| Longitudinal Tensile Elongation (%) | 25.2 | 23.5 | 23.8 | 25.0 |
| Longitudinal Strain Hardening Exp-N | 0.237 | 0.214 | 0.222 | 0.261 |
| Longitudinal Uniform Elongation (%) | 24.9 | 20.4 | 23.7 | 24.0 |
| Longitudinal LDH (Absolute Height - in.) | 1.010 | 0.900 | 0.960 | 1.023 |
| Longitudinal LDH (Adjusted Value - in.) | 0.980 | 0.880 | | |
| Transverse Guided Bend | 0.671 | 0.655 | | |
| Longitudinal Guided Bend | 0.478 | 0.374 | | |
| Longitudinal Stretch Bend - H/t | 34.0 | 27.2 | 31.8 | 36.2 |
| Transverse Stretch Bend - H/t | 32.6 | 26.7 | | |
| Bulge Height | 47.7 | 43.6 | 44.6 | 46.6 |

To demonstrate the importance of the presence of manganese in the practice of the present invention, aluminum alloy products were fabricated as before having the compositions shown in Table 8.

TABLE 8

| Example No. | Si | Mg | Cu | Fe | Mn |
|---|---|---|---|---|---|
| 47 | 0.97 | 0.43 | 0.47 | 0.09 | 0.00 |
| 48 | 0.85 | 0.26 | 0.95 | 0.09 | 0.05 |

TABLE 9

| Example No. | ASTM Grain Size | Number of Grains (per $mm^3$) |
|---|---|---|
| 47 | 2.0–3.0 | 381 |
| 48 | 3.0–4.0 | 1908 |

From Table 9, it is clear that Example 47, which contained no manganese, had less than 25% of the number of grains per $mm^3$ than Example 48. Since coarser grain sizes typically can cause orange peel or Lueders' lines to occur during deformation, it is desirable to maintain some low level of Mn in the material.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method for forming an aluminum alloy rolled sheet product particularly suitable for use for an automotive body, said process consisting essentially of:

(a) providing a body of an alloy comprising:

greater than 1.0 to about 1.3 wt. % silicon,
greater than 0.25 to about 0.6 wt. % magnesium,
about 0.5 to about 1.8 wt. % copper,
about 0.01 to about 0.1 wt. % manganese,
about 0.01 to about 0.2 wt. % iron, and
the balance being substantially aluminum and incidental elements and impurities;

(b) working said body to produce said sheet;

(c) solution heat treating said sheet; and (d) rapidly quenching said sheet.

2. The method of claim 1 in which said alloy contains:

greater than 1.0 to about 1.3 wt. % silicon,
greater than 0.25 to about 0.45 wt. % magnesium,
about 0.6 to about 1.5 wt. % copper,
about 0.04 to about 0.08 wt. % manganese, and
about 0.05 to about 0.17 wt. % iron.

3. The method of claim 1 in which (b) includes:

a plurality of discrete working steps with an intermediate anneal between at least two of said discrete working steps.

4. The method of claim 1 in which (b) includes:

a plurality of discrete working steps with an intermediate anneal at a temperature greater than about 600° F. between at least two of said discrete working steps.

5. The method of claim 1 in which (b) includes:

a plurality of discrete working steps with an intermediate anneal between at least two of said discrete working steps, said intermediate anneal lasting less than about 8 hours.

6. The method of claim 1 in which (c) includes:

solution heat treating said sheet at a temperature greater than about 842° F.

7. The method of claim 1 in which (c) includes:

solution heat treating said sheet in the temperature range of about 842° to 1115° F.

8. The method of claim 1 in which (d) includes:

rapid quenching.

9. An aluminum alloy suitable for use for an automotive body, said alloy comprising:

greater than 1.0 to about 1.3 wt. % silicon, greater than 0.25 to about 0.60 wt. % magnesium, about 0.5 to about 1.8 wt. % copper, about 0.01 to about 0.1 wt. % manganese, about 0.01 to about 0.2 wt. % iron, and the balance being substantially aluminum and incidental elements and impurities.

10. The alloy of claim 9 which includes:

greater than 1.0 to about 1.3 wt. % silicon, greater than 0.25 to about 0.45 wt. % magnesium, about 0.6 to about 1.5 wt. % copper, about 0.04 to about 0.08 wt. % manganese, and about 0.05 to about 0.17 wt. % iron.

11. An aluminum alloy sheet having improved combination of formability and strength suitable for forming into automotive body members, said aluminum alloy comprising:

greater than 1.0 to about 1.3 wt. % silicon, greater than 0.25 to about 0.60 wt. % magnesium, about 0.5 to about 1.8 wt. % copper, about 0.01 to about 0.1 wt. % manganese, about 0.01 to about 0.2 wt. % iron, and the balance being substantially aluminum and incidental elements and impurities; said alloy being produced by casting an ingot of the alloy, homogenizing the ingot, hot rolling the ingot to produce a slab, cold rolling said slab to produce sheet and solution heat treating said sheet.

12. The aluminum alloy sheet of claim 11 which includes:

greater than 1.0 to about 1.3 wt. % silicon, greater than 0.25 to about 0.45 wt. % magnesium, about 0.6 to about 1.5 wt. % copper, about 0.04 to about 0.08 wt. % manganese, and about 0.05 to about 0.17 wt. % iron.

13. A formed vehicular panel comprising a formed and age hardened article of aluminum alloy sheet, said aluminum alloy comprising:

greater than 1.0 to about 1.3 wt. % silicon, greater than 0.25 to about 0.60 wt. % magnesium, about 0.5 to about 1.8 wt. % copper, about 0.01 to about 0.1 wt. % manganese, about 0.01 to about 0.2 wt. % iron, and the balance being substantially aluminum and incidental elements and impurities; said alloy being produced by casting an ingot of the alloy, homogenizing the ingot, hot rolling the ingot to produce a slab, cold rolling said slab to produce sheet and solution heat treating said sheet.

14. The formed vehicular panel of claim 13 which includes:

greater than 1.0 to about 1.3 wt. % silicon, greater than 0.25 to about 0.45 wt. % magnesium, about 0.6 to about 1.5 wt. % copper, about 0.04 to about 0.08 wt. % manganese, and about 0.05 to about 0.17 wt. % iron.

15. The formed vehicular panel of claim 13 in which said aluminum alloy sheet is formed into an automotive door panel.

16. The formed vehicular panel of claim 13 in which said aluminum alloy sheet is formed into an automotive hood panel.

17. The formed vehicular panel of claim 13 in which said aluminum alloy sheet is formed into an automotive body panel.

18. The formed vehicular panel of claim 13 in which said aluminum alloy sheet is formed into fenders.

19. The formed vehicular panel of claim 13 in which said aluminum alloy sheet is naturally aged and has a yield strength greater than about 20 ksi.

20. The formed vehicular panel of claim 13 in which said aluminum alloy sheet is naturally aged and has a tensile elongation greater than about 29%.

21. The formed vehicular panel of claim 13 in which said aluminum alloy sheet is naturally aged and has a formability greater than about 1 inch limiting dome height for 0.036 inch gauge sheet.

22. The formed vehicular panel of claim 13 in which said aluminum alloy sheet is naturally aged and has a uniform elongation greater than about 25%.

23. The formed vehicular panel of claim 13 in which said aluminum alloy sheet is artificially aged by straining said sheet at least 1% and then heating to a temperature of about 350° C. for about 30 minutes, said aluminum alloy sheet having yield strength greater than about 23 ksi.

24. The formed vehicular panel of claim 13 which is substantially free of Lueders' lines after deformation or forming operations.

25. The method of claim 1 in which said alloy contains:

greater than 1.0 to about 1.3 wt. % silicon, greater than 0.25 to about 0.60 wt. % magnesium, about 0.5 to about 1.5 wt. % copper, about 0.01 to about 0.10 wt. % manganese, and about 0.01 to about 0.20 wt. % iron.

26. The alloy of claim 9 which includes:

greater than 1.0 to about 1.3 wt. % silicon, greater than 0.25 to about 0.60 wt. % magnesium, about 0.5 to about 1.5 wt. % copper, about 0.01 to about 0.10 wt. % manganese, and about 0.01 to about 0.20 wt. % iron.

27. The formed vehicular panel of claim 13 which includes:

greater than 1.0 to about 1.3 wt. % silicon, greater than 0.25 to about 0.60 wt. % magnesium, about 0.5 to about 1.5 wt. % copper, about 0.01 to about 0.10 wt. % manganese, and about 0.01 to about 0.20 wt. % iron.

28. The method of claim 1 in which said alloy contains:

greater than 1.0 to about 1.3 wt. % silicon, greater than 0.25 to about 0.60 wt. % magnesium, about 0.5 to about 1.8 wt. % copper, about 0.04 to about 0.08 wt. % manganese, and about 0.01 to about 0.20 wt. % iron.

29. The alloy of claim 9 which includes:

greater than 1.0 to about 1.3 wt. % silicon, greater than 0.25 to about 0.60 wt. % magnesium, about 0.5 to about 1.8 wt. % copper, about 0.04 to about 0.08 wt. % manganese, and about 0.01 to about 0.20 wt. % iron.

30. The formed vehicular panel of claim 13 which includes:

greater than 1.0 to about 1.3 wt. % silicon, greater than 0.25 to about 0.60 wt. % magnesium, about 0.5 to about 1.8 wt. % copper, about 0.04 to about 0.08 wt. % manganese, and about 0.01 to about 0.20 wt. % iron.

* * * * *

UNITED STATES PATENT AND TRADEMARK OFFICE

CERTIFICATE OF CORRECTION

PATENT NO. : 5,582,660

DATED : December 10, 1996

INVENTOR(S) : Rolf B. Erickson and Shawn J. Murtha

It is certified that error appears in the above-indentified patent and that said Letters Patent is hereby corrected as shown below:

Col. 16, line 31 Change "350°C" to --350°F--.
Claim 23

Signed and Sealed this

Twenty-second Day of July, 1997

Bruce Lehman

*Attest:*

BRUCE LEHMAN

*Attesting Officer*

*Commissioner of Patents and Trademarks*